United States Patent [19]

Laul

[11] Patent Number: 4,757,524

[45] Date of Patent: Jul. 12, 1988

[54] X-RAY GENERATOR

[75] Inventor: Virgil R. Laul, Dana Point, Calif.

[73] Assignee: Northrop Corporation, Hawthorne, Calif.

[21] Appl. No.: 841,398

[22] Filed: Mar. 19, 1986

[51] Int. Cl.[4] ..... H01J 35/00

[52] U.S. Cl. ..... 378/122; 378/121; 378/119

[58] Field of Search ..... 378/121, 122, 136, 119

[56] References Cited

U.S. PATENT DOCUMENTS

| | | | |
|---|---|---|---|
| 3,735,187 | 5/1973 | Rogers et al. | 378/122 |
| 4,570,106 | 2/1986 | Sohval et al. | 378/122 |
| 4,596,030 | 6/1986 | Herziger et al. | 378/122 |
| 4,602,376 | 7/1986 | Doucet et al. | 378/119 |

*Primary Examiner*—Janice A. Howell
*Assistant Examiner*—David P. Porta
*Attorney, Agent, or Firm*—Terry J. Anderson; Robert B. Block

[57] ABSTRACT

An improved X-ray tube including a coaxial tube with a center conductor isolated by a cylindrical insulator from a continuous annular interior conductor disposed about the insulator. The interior conductor includes sharp edged (high gradient) longitudinally aligned gaps in its surface with these gaps further generally aligned opposite one or more high atomic number targets deployed within the interior of a partially evacuated housing. A high voltage, high frequency AC or rapidly pulsed DC electrical excitation source is connected across the center and interior conductors to develop a high voltage electric field across the conductor gaps. A high voltage single or multiple pulse generating circuit is further connected across the interior conductor and the target to produce X-rays.

11 Claims, 1 Drawing Sheet

X-RAY GENERATOR

BACKGROUND OF THE INVENTION

1. Field of the Invention

The present invention relates to X-ray generators, and more particularly to X-ray generators incorporating a corona field cathode.

2. Description of the Prior Art

The physical mechanism involved in the production of X-rays is typically associated with electron transitions, i.e., the electromagnetic radiation that accompanies electron transition from one energy state to another. The origin of X-rays, is therefore mainly outside the nucleus, being based primarily on electron motion.

Based on these physical effects the prior art X-ray tube typically includes an electron source (cathode), a target (anode), a high voltage source to drive the electrons from the cathode to the anode, and a heating source to excite the cathode. These are all combined in a device, the X-ray tube, in which the electrons emitted from the cathode strike the anode, emitting broad band X-rays while decelerating and occasionally ejecting some of the anode electrons from the anode atoms, thereby forming electron vacancies. Electrons from higher energy states then makes transitions to fill the vacanies, transitions which are accompanied by the emission of photons of a characteristic frequency depending on the cathode material. Thus the prior art device generates X-ray photons.

The physical demands of an X-ray device, as typically implemented, are rather severe. For example, the typical voltage levels of prior art X-ray tubes are in the magnitude of 100 KEV. Even at these high voltages, shaping of the mechanical elements is extremely critical and subject to erosion and the cathode, quite often, has to be heated to temperatures commonly around 2500 degrees Kelvin. As a consequence present X-ray generation is difficult and expensive, demanding extreme tolerances in fabrication and installation. Some of these difficulties have been resolved by cathode shaping, such as the cathode shaping taught by Rogers et al. in U.S. Pat. No. 3,735,187. The teachings of Rogers et al, while suitable for their purpose, nonetheless are prone to erosion and techniques for reducing the effects of electrode erosion have been sought in the art.

A technique simplifying X-ray production in a device which is virtually immune from erosion is therefore sought in the art. Such a technique is disclosed herein.

SUMMARY OF THE INVENTION

Accordingly, it is the general purpose and object of the present invention to provide an elongate, coaxial X-ray tube which is virtually immune to degeneration with use.

Other objects of the invention are to provide an X-ray tube which combines a corona discharge at the cathode with a high voltage potential drop across the cathode and anode.

Yet further objects of the invention are to provide an X-ray tube which is convenient in manufacture and use.

Briefly, these and other objects are accomplished within the present invention by enclosing a cylindrical center conductor within the interior of an annular insulation having formed about the partial exterior thereof a thin, tubular, exterior conductor. This tubular conductor surrounds only a portion of the circumference of the insulator to expose a slit or gap between the longitudinal edges of the conductor. The gap is aligned with and runs parallel to with a high Z (high atomic number) target attached to the opposing interior surface of an outer cylindrical housing. This housing is partially evacuated when in use and may be formed of insulating material concentrically deployed around the periphery of the tubular conductor (cathode), or alternatively may comprise a high Z (high atomic number) structure or a metal housing with a high Z target formed thereon.

A high frequency, high voltage generator or repetitive pulse generator is connected between the cylindrical center conductor and the tubular conductor to develop a high voltage gradient at the edges of the gap in the tubular conductor. With the X-ray tube evacuated to a pressure of five to one hundred microns, the high voltage gradient causes a corona discharge to form over the exposed surface of the annular insulator. A high voltage single or multiple pulse generator (such as, for example, a DC voltage stored in a capacitor until the cathode is triggered) is connected between the tubular conductor and the target to accelerate electrons within the coronal plasma toward the target (anode) during each pulse. These accelerated electrons collide with the target material and emit X-rays.

One of the novel aspects of the foregoing structure is its relative insensitivity to electrode erosion. Any erosion of the tubular conductor, or increase in the spacing of the gap simply translates the location of the high gradient region at the edges of the gap with minimal effect on the produced corona.

Thus a conveniently fabricated X-ray tube is devised. This X-ray tube, through the convenience of controlled deposition of the tubular conductor, thus allows for an extended useful life with minimal fabrication difficulty.

DESCRIPTION OF THE SPECIFIC EMBODIMENTS

Figure 1:
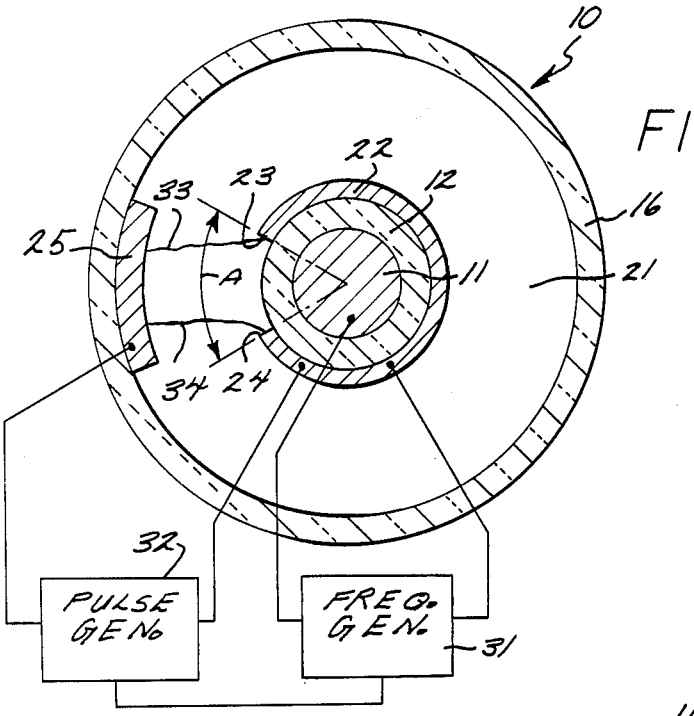
FIG. 1 is a sectional view of an X-ray tube constructed according to the present invention.
Figure 3:
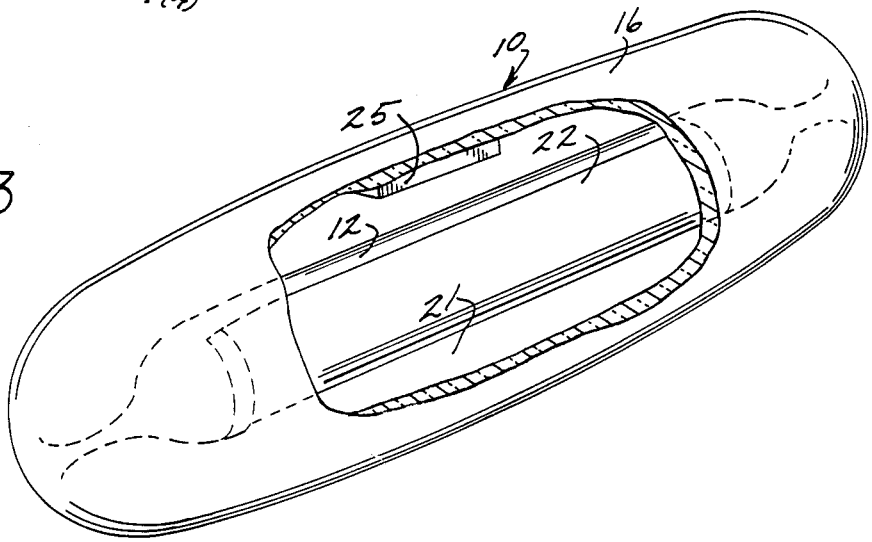
FIG. 3 is a perspective illustration of the present inventive X-ray tube, in partial section.

As shown in FIGS. 1 and 3, the present inventive X-ray tube, generally designated 10, comprises a center conductor 11 intimately housed within the interior of an annular insulator 12 of high dielectric material such as, for example, alumina ($Al_2O_3$). Thus insulator 12 forms a tubular structure extending concentrically through the interior of a housing 16 which, once again, may be formed of an insulating material. In this manner the interior annular insulator 12 is aligned axially within the interior of the housing 16 forming an annular, partially evacuated cavity therebetween, shown as cavity 21.

Formed around the exterior periphery of the annular insulator 12 and extending over a substantial portion of arc thereof is an interior conductor 22 of durable material such as, for example, stainless steel. This interior conductor 22 has a generally tubular shape extending between longitudinal conductor edges 23 and 24 aligned over an arc A to define a gap opposite a curved target 25 fixed to the opposite interior surface of the tubular housing 16. The interior conductor 22 may be alternatively formed from a suitable metal coating deposited onto the exterior of the annular insulator 12. A high frequency, high voltage generator 31 is connected across the center conductor 11 and the interior conductor 22 to impose a high intensity electric field onto the conductor 22. High voltage generator 31 may either be a high frequency AC type generator or a high repetition rate pulsed DC type generator. The high intensity field produced by generator 31 causes a charge concentration to collect at the conductor edges 23 and 24 resulting in a coronal discharge. A high voltage single or multiple pulse circuit 32 is further connected between the interior conductor 22 and the target 25. This pulse generator 31 applies a periodic high voltage pulse of sufficient voltage to cause a breakdown in the high voltage regions at the conductor edges 23 and 24, causing a discharge which accelerates electrons toward the target 25 through the partially evacuated cavity 21 along and within the discharge paths 33 and 34 shown in FIGS. 1 and 2. It should be understood that if the high voltage generator 31 is a high repetition rate pulsed DC type generator, the pulse circuit 32 should be operated in phase with the pulses from the high voltage generator 31.

Figure 2:
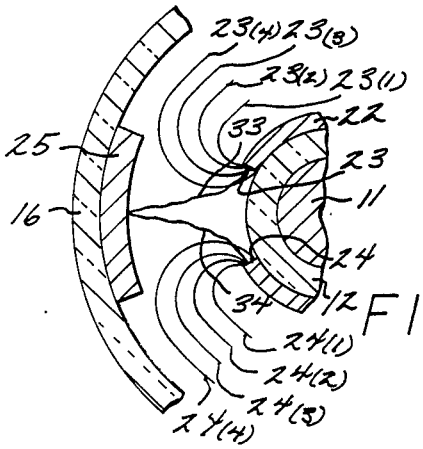
FIG. 2 is a detailed illustration of the plasma region developed according to the invention herein.

By reference to FIG. 2, the effects discussed herein entail the formation of high gradient charges at the edges 23 and 24, along field lines of gradients 23(1)–23(4) and 24(1)–24(4). In the presence of the high fields a coronal plasma occurs along paths 33 and 34.

The target 25 may be made of any high Z material, such as, for example, tungsten. A residual gas in the cavity 21, partly evacuated to a pressure of 5–100 microns, provides the source of the plasma. Thus, the necessary voltages, gradients and plasma densities are provided for efficient generation of X-rays.

Figure 4:
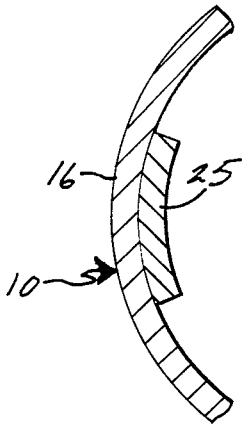
FIG. 4 is a sectional detail of an alternative material structure useful with the present invention.

One should note that the exterior housing 16 is not limited in its material structure to a dielectric material. By way of example, illustrated in FIG. 4, housing 16 may be formed of a metallic structure which is partly or wholly X-ray transmissive, the production of X-rays being principally determined by the electron collisions into the material of the target 25.

Obviously many modifications and charges may be made to the foregoing description without departing from the spirit of the invention. For example, the interior conductor 22 may be provided with more than one gap and further targets 25 disposed within the interior of the housing 16, opposite these additional gaps, to provide several X-rays beams from a single tube 10. Consequently, the scope of the present invention should not be limited by the particular embodiments discussed above, but should be defined only by the claims set forth below and equivalents thereof.

What is claimed is:

1. An X-ray generator comprising:

an elongate center conductor;

an insulating sheath enclosing said center conductor;

an interior conductor formed around a substantial portion of an exterior surface of said insulating sheath and electrically insulated from said center conductor, said interior conductor forming a gap defined by the edges thereof along a portion of the exterior surface of said sheath;

an elongate exterior housing enclosing said center conductor, said sheath and said interior conductor in spaced alignment relative thereof;

an electron target of high Z material attached to an interior surface of said exterior housing in opposition to said interior conductor gap;

an ionizable gas filling said gap at low pressure;

a source of high frequency electrical excitation connected across said center and interior conductors to create an electric field intensity in the gap sufficient to form a corona discharge in the gas, but less than that which would cause an arc discharge through the insulating sheath adjacent said gap, said corona discharge serving as a plasma cathode at said gap; and a high voltage pulse generator connected across said interior conductor and said target to accelerate electrons from the corona discharge into said high Z target to form hard X-rays.

2. Apparatus according to claim 1 wherein:

said target includes a high atomic number material structure like tungsten.

3. Apparatus according to claim 1 wherein: said housing is partially evacuated to between five to one-hundred microns.

4. The X-ray generator of claim 1 wherein the high frequency electrical source is a high repetition rate DC type generator.

5. Apparatus according to claim 4 wherein:

said pulse generator is controlled to generate pulses in phase with said source.

6. Apparatus for generating electromagnetic radiation in the X-ray spectrum, comprising:

a partially evacuated housing;

a center conductor extending through said housing;

an insulating sheath formed around said center conductor;

a conductive sheet fixed to an exterior surface of said insulating sheath and electrically insulated from said center conductor by said insulating sheath, said conductive sheet further forming a gap between the edges thereof about a portion of the insulating sheath exterior surface;

an ionizable gas filling said gap at low pressure;

a target mounted on said housing opposite said gap;

a first source of fast rise time electrical excitation connected between said center conductor and said conductive sheet to create an electric field intensity in the gap and volume sufficient to form a corona discharge in the gas, but less than that which would cause an arc discharge through the insulating sheath at said gap, said corona discharge serving as a plasma cathode in said gap; and a second source of high voltage electrical excitation connected between said conductive sheet and said target.

7. Apparatus according to claim 6 further comprising:

a first source of fast rise time electrical excitation connected between said center conductor and said conductive sheet; and a second source of high voltage electrical excitation connected between said conductive sheet and said target.

8. Apparatus according to claim 6 wherein:

said target includes a material class of high atomic number including tungsten.

9. The apparatus according to claim 6 wherein said housing is a dielectric material.

10. An X-ray generator comprising, a first electrode defining a conductive surface, a solid insulator covering said surface in a region thereof, a second electrode, a third electrode, said second second and third electrodes lying on a surface substantially parallel to said surface and in contact with said insulator on the side away from said first electrode and spaced apart from each other to form a gap therebetween adjacent said insulator at the region.

said gap being bounded by said insulator and said second and third electrodes to form a volume closed on three sides, which volume is open to the side away from said insulator and opposite said conductive surface, said gap generally defining a region parallel to said conductive surface, an ionizable gas filling said volume at low pressure, means for applying an electric potential between the first electrode and the second and third electrodes to create an electric field intensity in the gap and volume sufficient to form a corona discharge in the gas, but less than that which would cause an arc discharge through the insulator at said region, said corona discharge serving as a plasma cathode in said volume, an anode of high Z material spaced away from the gap on the side away from the first electrode and facing said volume, and means for creating an electric field between the plasma cathode and the anode to accelerate electrons from the corona discharge into said high Z material to form hard X-rays.

11. Apparatus according to claim 10 further in which said first means is a first source of fast rise time electrical excitation connected between said center conductor and said conductive sheet; and in which said second means is a second source of high voltage electrical excitation connected between said conductive sheet and said target.

* * * * *